US008690624B2

(12) United States Patent
Kato et al.

(10) Patent No.: US 8,690,624 B2
(45) Date of Patent: Apr. 8, 2014

(54) VESSEL PROPULSION APPARATUS

(75) Inventors: Shuji Kato, Shizuoka (JP); Satoshi Miyazaki, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 72 days.

(21) Appl. No.: 13/549,538

(22) Filed: Jul. 16, 2012

(65) Prior Publication Data

US 2013/0203308 A1 Aug. 8, 2013

(30) Foreign Application Priority Data

Feb. 8, 2012 (JP) ..... 2012-025113

(51) Int. Cl.
*B63H 20/24* (2006.01)
*F01N 3/10* (2006.01)

(52) U.S. Cl.
USPC ..... 440/89 C; 440/89 H; 440/89 R

(58) Field of Classification Search
USPC ..... 440/89 C, 89 F, 89 H, 89 R
See application file for complete search history.

(56) References Cited

U.S. PATENT DOCUMENTS

| | | | | |
|---|---|---|---|---|
| 5,494,467 | A * | 2/1996 | Sohgawa et al. | 440/89 R |
| 5,911,608 | A * | 6/1999 | Nakayama et al. | 440/89 R |
| 7,867,048 | B2 | 1/2011 | Ochiai | |
| 8,011,985 | B2 * | 9/2011 | Ochiai | 440/89 H |
| 2010/0240269 | A1 | 9/2010 | Ochiai | |

* cited by examiner

*Primary Examiner* — Lars A Olson
(74) *Attorney, Agent, or Firm* — Keating & Bennett, LLP

(57) ABSTRACT

A vessel propulsion apparatus includes a first exhaust passage including an upward guiding portion that guides exhaust generated by an engine upward, a second exhaust passage disposed at a downstream side relative to the first exhaust passage, and a communication passage communicating the first exhaust passage and the second exhaust passage with each other. The communication passage includes a first upstream end opening at the first exhaust passage and a second downstream end disposed below the first upstream end and opening at the second exhaust passage. Further, the communication passage includes an expanded portion disposed at a height in between the first upstream end and the second downstream end and being more expanded than the first upstream end and the second downstream end.

12 Claims, 5 Drawing Sheets

VESSEL PROPULSION APPARATUS

BACKGROUND OF THE INVENTION

1. Field of the Invention

The present invention relates to a vessel propulsion apparatus.

2. Description of the Related Art

A known vessel propulsion apparatus includes an exhaust passage by which exhaust discharged from a combustion chamber is discharged underwater. The exhaust passage does not extend upward toward a downstream side but extends downward to an exhaust outlet that opens underwater. Thus, even if condensed water forms due to cooling of the exhaust inside the exhaust passage, the water flows downward inside the exhaust passage and moves away from the combustion chamber. Engine misfire due to entry of condensed water thus does not occur. Engine stall due to misfire thus does not occur with the conventional vessel propulsion apparatus.

Meanwhile, U.S. Pat. No. 7,867,048 B2 and U.S. Patent Application Publication No. 2010/0240269 A1 disclose a vessel propulsion apparatus that includes an exhaust passage by which exhaust discharged from a combustion chamber is discharged underwater and a condensed water passage connected to the exhaust passage. The exhaust passage includes an upward guiding portion that guides the exhaust upward. An upstream end of the condensed water passage is connected to a lower end portion of the upward guiding portion. Condensed water formed by cooling of the exhaust collects at the lower end portion of the upward guiding portion and is discharged into the condensed water passage. Entry of condensed water into the combustion chamber is thereby prevented.

SUMMARY OF THE INVENTION

The inventors of preferred embodiments of the present invention described and claimed in the present application conducted an extensive study and research regarding a vessel propulsion apparatus, such as the one described above, and in doing so, discovered and first recognized new unique challenges and previously unrecognized possibilities for improvements as described in greater detail below.

Specifically, with the arts disclosed in U.S. Pat. No. 7,867,048 B2 and U.S. Patent Application Publication No. 2010/0240269 A1, the exhaust passage is connected to an exhaust outlet that opens underwater. Further, the upstream end of the condensed water passage is connected to the lower end portion of the upward guiding portion, and a downstream end of the condensed water passage is connected to the exhaust passage at a downstream side relative to the upward guiding portion. Thus, when seawater, etc., flowing into the exhaust passage from the exhaust outlet flows in reverse toward the combustion chamber, the water may flow through the condensed water passage into the lower end portion of the upward guiding portion and enter into the combustion chamber.

In order to overcome the previously unrecognized and unsolved challenges described above, a preferred embodiment of the present invention provides a vessel propulsion apparatus that includes an engine, a first exhaust passage, a second exhaust passage, an exhaust outlet, and a communication passage. The engine includes a crankshaft rotatable around a crank axis extending in a vertical direction. The first exhaust passage includes an upward guiding portion by which exhaust generated by the engine is guided upward. The second exhaust passage is disposed at a downstream side relative to the first exhaust passage and guides the exhaust generated by the engine. The exhaust guided by the second exhaust passage is discharged underwater by the exhaust outlet. The communication passage communicates the first exhaust passage with the second exhaust passage. The communication passage includes a first upstream end opening at the first exhaust passage and a second downstream end disposed below the first upstream end and opening at the second exhaust passage. Further, the communication passage includes an expanded portion disposed at a height in between the first upstream end and the second downstream end and being more expanded, i.e., having a larger cross-sectional area, than the first upstream end and the second downstream end. A flow passage area of the expanded portion is preferably greater than an opening area of either of the first upstream end and the second downstream end.

With this arrangement of the present preferred embodiment of the present invention, the exhaust generated by the engine passes through the first exhaust passage and the second exhaust passage and is discharged underwater from the exhaust outlet. The first exhaust passage includes the upward guiding portion that guides the exhaust upward and is connected to the second exhaust passage by the communication passage. Condensed water formed by cooling of the exhaust collects at a lower end portion of the upward guiding portion and is discharged into the second exhaust passage via the communication passage. Entry of the condensed water into a combustion chamber can thereby be prevented. Further, the communication passage includes the first upstream end opening at the first exhaust passage, the second downstream end opening at the second exhaust passage, and the expanded portion disposed at the height in between the first upstream end and the second downstream end. The expanded portion is more expanded than the first upstream end and the second downstream end. Thus, even if water flowing in reverse toward the combustion chamber enters into the communication passage from the second downstream end, a thrust (flow velocity) of the water is weakened at the expanded portion. Reverse flow of water from the communication passage into the first exhaust passage and entry of the water into the combustion chamber can thus be prevented. Engine misfire can thereby be prevented.

The communication passage may include a first downstream end and a second upstream end opening at the expanded portion, a first passage portion connecting the first upstream end and the first downstream end and being narrower than the expanded portion, and a second passage portion connecting the second upstream end and the second downstream end and being narrower than the expanded portion. In this case, the second upstream end may be disposed at a position that is not on an extension line of the first passage portion. The second upstream end is preferably disposed at a position that is not on an extension line of a downstream end of the first passage portion.

Water that flows in reverse in the communication passage passes through the second passage portion and is jetted into the expanded portion from the second upstream end. With this arrangement of the present preferred embodiment of the present invention, the second passage portion is offset with respect to the first passage portion and thus the first downstream end and the second upstream end do not face each other in a water jetting direction from the second upstream end. Water jetted from the second upstream end can thus be prevented from entering directly into the first downstream end. Water flowing in reverse in the second passage portion can thus be prevented from entering into the first passage portion. Water flowing in reverse inside the second exhaust passage can thereby be prevented from passing through the communication passage and entering into the combustion chamber.

Also, the communication passage may further include a first downstream end and a second upstream end opening at the expanded portion, a first passage portion connecting the first upstream end and the first downstream end and being narrower than the expanded portion, and a second passage portion connecting the second upstream end and the second downstream end and being narrower than the expanded portion. In this case, the second upstream end may be disposed on an extension line of the first passage portion and the second passage portion may be inclined with respect to the first passage portion.

With this arrangement of the present preferred embodiment of the present invention, the second upstream end is disposed on the extension line of the first passage portion and the second passage portion is inclined with respect to the first passage portion. Water flowing in reverse in the second passage portion is jetted in a direction along an extension line of the second passage portion. Thus, the first downstream end and the second upstream end face each other in a direction along the extension line of the first passage portion but do not oppose each other in the water jetting direction from the second upstream end. The water jetted from the second upstream end can thus be prevented from entering directly into the first downstream end. Water flowing in reverse in the second passage portion can thereby be prevented from entering into the first passage portion.

Also, the communication passage may further include a first passage portion connecting the first upstream end and the expanded portion and being narrower than the expanded portion and a second passage portion connecting the expanded portion and the second downstream end and being narrower than the expanded portion. In this case, a flow passage area of the first passage portion may be greater than a flow passage area of the second passage portion. In a case where the flow passage areas of the first passage portion and the second passage portion are not fixed, it is preferable for at least a minimum flow passage area of the first passage portion to be greater than a minimum flow passage area of the second passage portion.

With this arrangement of the present preferred embodiment of the present invention, the flow passage area of the first passage portion is greater than the flow passage area of the second passage portion and thus condensed water inside the first exhaust passage is discharged more reliably to the communication passage. Meanwhile, the flow passage area of the second passage portion is smaller than the flow passage area of the first passage portion and thus water flowing in reverse inside the second exhaust passage cannot easily enter into the second passage portion. An amount of water flowing in reverse from the second exhaust passage to the communication passage can thus be reduced.

Also, the communication passage may further include a first downstream end and a second upstream end opening at the expanded portion, a first passage portion connecting the first upstream end and the first downstream end and being narrower than the expanded portion, and a second passage portion connecting the second upstream end and the second downstream end and being narrower than the expanded portion. In this case, the second upstream end may open at a lowermost end of the expanded portion.

With this arrangement of the present preferred embodiment of the present invention, the second upstream end opens at the lowermost end of the expanded portion and thus water inside the expanded portion is discharged reliably to the second upstream end. The amount of condensed water remaining in the expanded portion can thus be reduced. The condensed water may contain sulfur components because it is water formed by cooling of exhaust. When such water remains in the expanded portion, an inner wall surface of the expanded portion may corrode. The inner wall surface of the expanded portion may likewise corrode when seawater or other water that flows in reverse into the expanded portion remains in the expanded portion. Corrosion of the communication passage can thus be prevented by reliably discharging the water inside the expanded portion.

Also, the first upstream end may open at a lowermost end of the first exhaust passage. With this arrangement of the present preferred embodiment of the present invention, condensed water inside the first exhaust passage is reliably discharged to the first upstream end. Condensed water remaining inside the first exhaust passage can thus be prevented.

Also, the vessel propulsion apparatus may further include a connection passage connecting the first exhaust passage and the second exhaust passage and having a catalyst disposed therein. With this arrangement of the present preferred embodiment of the present invention, the first exhaust passage and the second exhaust passage are connected by the connection passage and the catalyst is disposed in the connection passage. Exhaust flows from the first exhaust passage into the connection passage and thereafter flows from the connection passage to the second exhaust passage. The exhaust is thereby purified. Further, the first exhaust passage and the second exhaust passage are connected by the communication passage and thus condensed water inside the first exhaust passage can be prevented from moving into the connection passage and wetting the catalyst. Degradation of the catalyst can thereby be prevented.

The vessel propulsion apparatus may further include a water jacket that cools at least a portion of the first exhaust passage. With this arrangement of the present preferred embodiment of the present invention, the first exhaust passage is heated by exhaust and at least a portion of the first exhaust passage is cooled by the water jacket. An increase in temperature of the first exhaust passage can thus be minimized. Further, the communication passage that discharges condensed water is connected to the first exhaust passage and thus condensed water formed by cooling of the first exhaust passage can be discharged from the first exhaust passage. Entry of the condensed water into the combustion chamber can thereby be prevented.

The vessel propulsion apparatus may further include a cooling device that supplies water outside the vessel propulsion apparatus to the water jacket. With this arrangement of the present preferred embodiment of the present invention, water outside the vessel propulsion apparatus, that is, sea, lake, or river water is supplied to the water jacket by the cooling device. With an internal circulation type cooling device that is included in an automobile, etc., warmed cooling water may be supplied to the water jacket. On the other hand, water outside the vessel propulsion apparatus is not heated by the vessel propulsion apparatus and thus the cooling device can more surely supply water having a low temperature to the water jacket. The cooling device can thus minimize a temperature increase of the first exhaust passage more than an internal circulation type cooling device.

Also, the expanded portion may be defined by a plurality of members. For example, the expanded portion may be defined by a cylinder head and an exhaust pipe. In this case, the expanded portion is preferably defined by members that are normally provided in an engine and thus a new member to define the expanded portion does not have to be provided.

Also, the expanded portion may include a pair of recessed portions that are provided at the plurality of members and overlapped in a mutually facing state. For example, a recessed portion provided at an end surface of a cylinder head and a recessed portion provided at an end surface of an exhaust pipe may be overlapped in a mutually facing state. In this case, the expanded portion can be defined easily because it suffices to simply provide the recessed portions at the cylinder head and the exhaust pipe. Further, volumes of the cylinder head and the exhaust pipe are reduced by providing the recessed portions, and the vessel propulsion apparatus can thus be made lighter in weight.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
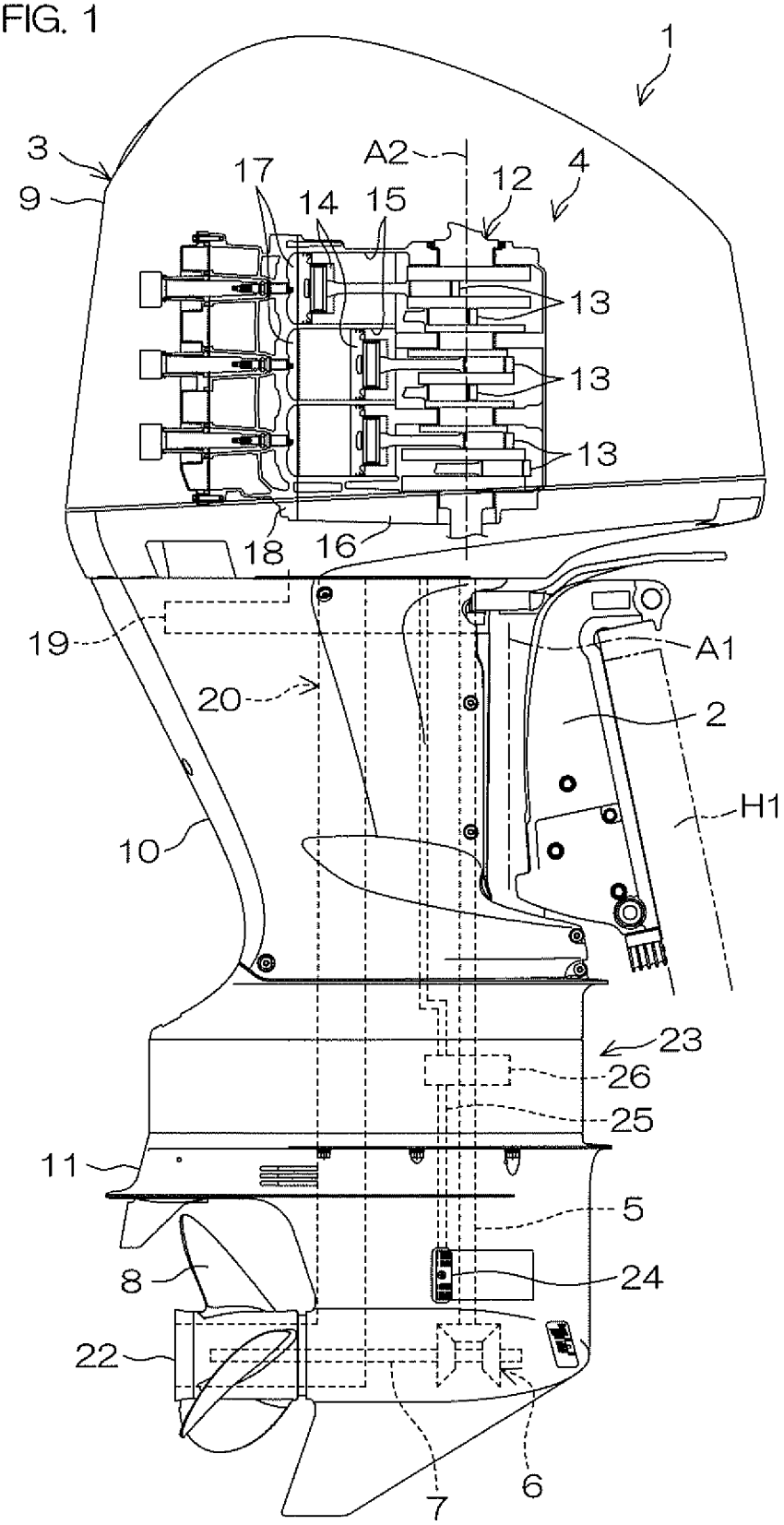
FIG. 1 is a side view of a vessel propulsion apparatus according to a preferred embodiment of the present invention.

FIG. 1 is a side view of a vessel propulsion apparatus 1 according to a preferred embodiment of the present invention. To facilitate understanding, FIG. 1 shows an interior of an engine cover 9 in a see-through manner.

The vessel propulsion apparatus 1 includes a bracket 2 attachable to a rear portion of a hull H1 and an outboard motor 3 supported by the bracket 2 in a manner enabling rotation around a steering axis A1 extending in a vertical direction.

The outboard motor 3 includes an engine 4, a driveshaft 5, a forward-reverse switching mechanism 6, and a propeller shaft 7. The outboard motor 3 further includes the engine cover 9 housing the engine 4, an upper casing 10 disposed below the engine cover 9, and a lower casing 11 disposed below the upper casing 10. The driveshaft 5 extends downward from the engine 4, and a lower end portion of the driveshaft 5 is coupled to a front end portion of the propeller shaft 7 via the forward-reverse switching mechanism 6. The propeller shaft 7 extends in a front/rear direction inside the lower casing 11. A rear end portion of the propeller shaft 7 protrudes rearward from the lower casing 11. A propeller 8 is coupled to the rear end portion of the propeller shaft 7. The propeller 8 is disposed in the water.

The engine 4 is an internal combustion engine. The engine 4 is preferably a multi-cylinder engine, or the engine 4 may be a single-cylinder engine. The engine 4 includes a crankshaft 12 rotatable around a crank axis A2 extending in the vertical direction, a plurality of connecting rods 13 coupled to the crankshaft 12, and a plurality of pistons 14 respectively coupled to the plurality of connecting rods 13. Further, the engine 4 includes a cylinder body 16 that includes a plurality of cylinders 15, and a cylinder head 18 that includes a plurality of combustion chambers 17. An upper end portion of the driveshaft 5 is coupled to a lower end portion of the crankshaft 12.

The engine 4 rotates the crankshaft 12 in a fixed rotation direction. The rotation of the engine 4 (rotation of the crankshaft 12) is transmitted to the propeller 8 by the driveshaft 5, the forward-reverse switching mechanism 6, and the propeller shaft 7. A rotation direction of the propeller 8 is switched between a forward drive direction (for example, a clockwise direction as viewed from the rear of the propeller 8) and a reverse drive direction (the direction opposite the forward drive direction) by the forward-reverse switching mechanism 6. That is, when a vessel operator performs a shift operation, the forward-reverse switching mechanism 6 transmits the rotation from the driveshaft 5 to the propeller shaft 7 so that the rotation direction of the propeller shaft 7 is reversed. The rotation direction of the propeller 8 is thereby switched.

The outboard motor 3 further includes an exhaust guide 19 that supports the engine 4. The exhaust guide 19 is disposed below the engine 4 in the outboard motor 3. By the exhaust guide 19, the engine 4 is supported and exhaust generated in the combustion chambers 17 is guided downward. That is, the outboard motor 3 includes a main exhaust passage 20 by which the exhaust generated in the combustion chambers 17 is guided to the propeller 8. The exhaust guide 19 defines a portion of the main exhaust passage 20. The main exhaust passage 20 includes a plurality of exhaust ports 21 (see FIG. 2) as exhaust inlets into which the exhaust generated in the plurality of combustion chambers 17 flow and an exhaust outlet 22 that opens at a boss portion of the propeller 8. The exhaust generated in the plurality of combustion chambers 17 flows from the plurality of exhaust ports 21 into the main exhaust passage 20. When an exhaust pressure inside the main exhaust passage 20 increases, the exhaust inside the main exhaust passage 20 is discharged underwater from the exhaust outlet 22.

The outboard motor 3 further includes a cooling device 23 that supplies cooling water to a water jacket Wj (see FIG. 2) provided in an internal arrangement of the outboard motor 3, including in the engine 4, etc. The cooling device 23 includes a water intake port 24 opening at an outer surface of the outboard motor 3 (outer surface of the lower casing 11), a water supply passage 25 connecting the water intake port 24 and the water jacket Wj, and a water pump 26 disposed on the water supply passage 25. The water pump 26 is coupled to the driveshaft 5. When the engine 4 rotates, water outside the outboard motor 3 is supplied as cooling water to the water jacket Wj by the water pump 26. Water that has passed through the water jacket Wj is discharged outside the outboard motor 3. The internal arrangement of the outboard motor 3, including the engine 4, etc., is thereby cooled. The cooling device 23 supplies water outside the outboard motor 3, that is, sea, lake, or river water to the interior of the outboard motor 3 and can thus more surely supply cooling water having a low temperature to the outboard motor 3 than an internal circulation type cooling device provided in an automobile, for example. The outboard motor 3 is thus more surely maintained at a low temperature.

Figure 2:
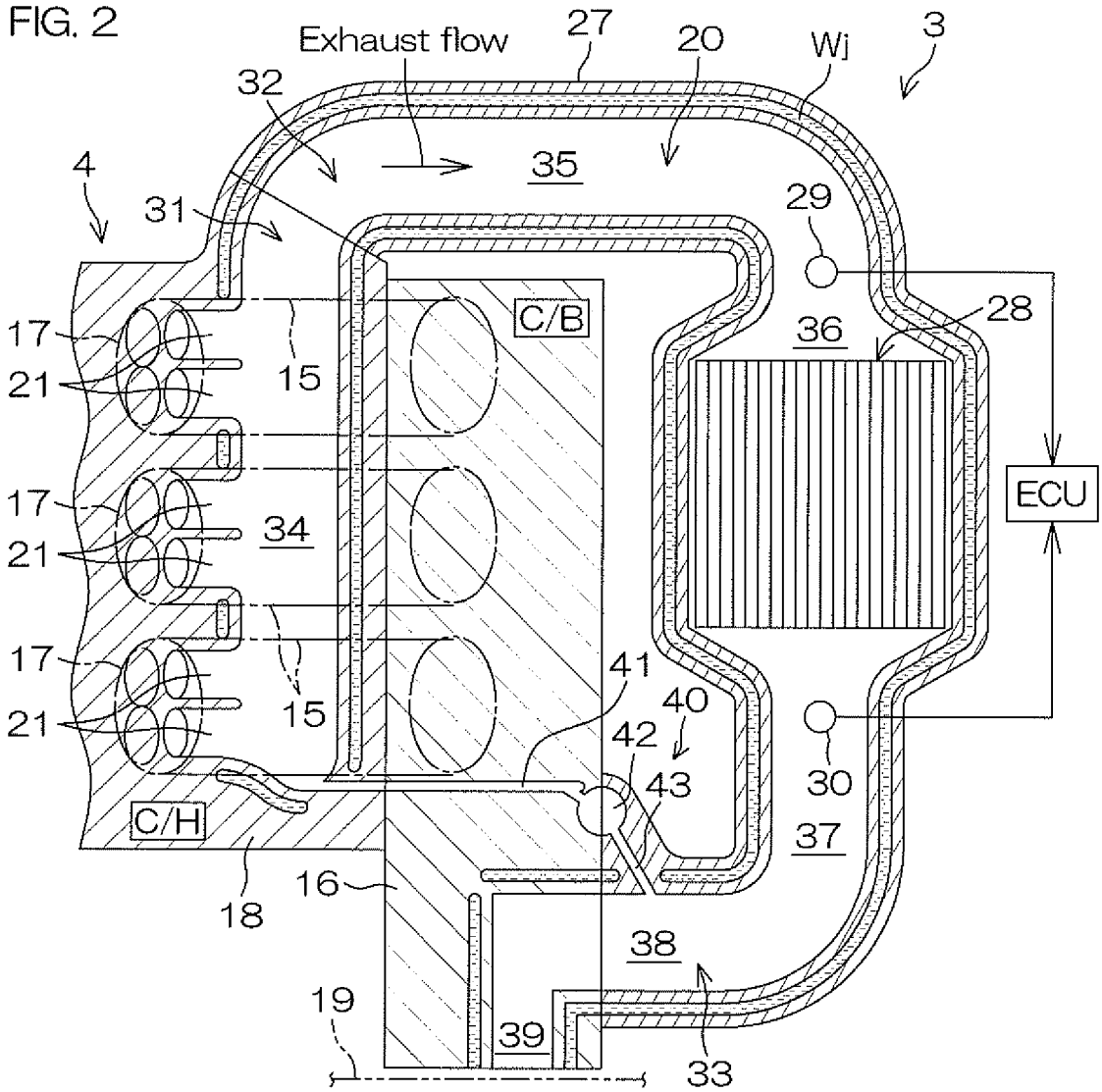
FIG. 2 is a schematic view of a portion of a main exhaust passage guiding exhaust from combustion chambers into an interior of an exhaust guide.

FIG. 2 is a schematic view of a portion of the main exhaust passage 20 that guides the exhaust from the combustion chambers 17 into the interior of the exhaust guide 19.

The outboard motor 3 includes an exhaust pipe 27 attached to the engine 4 and a catalyst 28 disposed inside the exhaust pipe 27. An upstream end and a downstream end of the exhaust pipe 27 are attached to the cylinder head 18 and the cylinder body 16, respectively. The exhaust pipe 27 may be a single pipe or may be a plurality of pipes. An internal space of the exhaust pipe 27 is partitioned into an upstream side and a downstream side by the catalyst 28. The catalyst 28 is, for example, a three-way catalyst. The catalyst 28 preferably includes a honeycomb-shaped carrier with an interior partitioned into a plurality of cells by partition walls extending in an exhaust flow direction and a catalytic substance held by the carrier. All of the exhaust guided into the exhaust pipe 27 passes through the catalyst 28. The exhaust is thereby purified.

The outboard motor 3 further includes an upstream sensor 29 and a downstream sensor 30 attached to the exhaust pipe 27. The upstream sensor 29 is attached to the exhaust pipe 27 at an upstream side relative to the catalyst 28 in the exhaust flow direction, and the downstream sensor 30 is attached to the exhaust pipe 27 at a downstream side relative to the catalyst 28 in the exhaust flow direction. A portion of each of the upstream sensor 29 and the downstream sensor 30 is disposed inside the exhaust pipe 27. The upstream sensor 29 and the downstream sensor 30 preferably are oxygen concentration sensors that contain a ceramic (for example, zirconia). The upstream sensor 29 and the downstream sensor 30 may be air-fuel ratio sensors. Oxygen concentration sensors and air-fuel ratio sensors are examples of exhaust sensors that detect a concentration of a component contained in exhaust. Detection values of the upstream sensor 29 and the downstream sensor 30 are input into an ECU (electronic control unit) that controls the engine 4. The ECU adjusts a fuel injection amount of a fuel injection device, etc., based on the detection values from the upstream sensor 29 and the downstream sensor 30.

The main exhaust passage 20 includes a first exhaust passage 31 connected to the plurality of combustion chambers 17, a connection passage 32 connected to the first exhaust passage 31, and a second exhaust passage 33 connected to the connection passage 32. The first exhaust passage 31 is defined by the cylinder head 18, and the connection passage 32 is defined by the exhaust pipe 27. The second exhaust passage 33 is defined by the exhaust pipe 27 and the cylinder body 16. The second exhaust passage 33 is a portion of the main exhaust passage 20 positioned below the first exhaust passage 31. The first exhaust passage 31, the connection passage 32, and the second exhaust passage 33 are disposed inside the engine cover 9 (see FIG. 1). The water jacket Wj is disposed along the first exhaust passage 31, the connection passage 32, and the second exhaust passage 33. Inner wall surfaces of the first exhaust passage 31, the connection passage 32, and the second exhaust passage 33 are thus heated by the exhaust and cooled by the cooling water.

The first exhaust passage 31 includes an upward guiding portion 34 connected to the respective exhaust ports 21. The plurality of exhaust ports 21 are respectively disposed at different heights. The upward guiding portion 34 extends upward from the respective exhaust ports 21. The uppermost exhaust port 21 is disposed below an upper end (downstream end) of the first exhaust passage 31. The lowermost exhaust port 21 is disposed above a lower end of the upward guiding portion 34 (corresponding to a lower end of the first exhaust passage 31). The upward guiding portion 34 collects the exhaust flowing in from the respective exhaust ports 21 and guides the exhaust upward toward the downstream end of the first exhaust passage 31. The exhaust that reaches the downstream end of the first exhaust passage 31 is discharged toward the connection passage 32 from the downstream end of the first exhaust passage 31. The first exhaust passage 31 thus defines an exhaust manifold that guides the exhaust to the exhaust pipe 27.

The connection passage 32 includes an upstream portion 35 connected to the downstream end of the first exhaust passage 31, a midstream portion 36 connected to the upstream portion 35, and a downstream portion 37 connected to the midstream portion 36. The downstream portion 37 is connected to an upstream end of the second exhaust passage 33. The downstream portion 37 is disposed below the upstream portion 35. The midstream portion 36 is disposed at a height in between the upstream portion 35 and the downstream portion 37. The catalyst 28 is disposed in the midstream portion 36. A flow passage area (i.e., a cross-sectional area) of the midstream portion 36 is greater than a flow passage area of either of the upstream portion 35 and the downstream portion 37. The midstream portion 36 extends downward from the upstream portion 35. The downstream portion 37 extends downward from the midstream portion 36. Exhaust that flows into the connection passage 32 from the first exhaust passage 31 thus passes through the catalyst 28 from above to below and is thereby purified. The purified exhaust is discharged toward the second exhaust passage 33 from a downstream end of the connection passage 32.

The second exhaust passage 33 includes a rearward guiding portion 38 connected to the downstream end of the connection passage 32 and a downward guiding portion 39 connected to the rearward guiding portion 38. The rearward guiding portion 38 extends rearward from the connection passage 32 (to the left in FIG. 2), and the lower guiding portion 39 extends downward from the rearward guiding portion 38. The rearward guiding portion 38 is defined by the exhaust pipe 27 and the cylinder body 16, and the downward guiding portion 39 is defined by the cylinder body 16. The rearward guiding portion 38 and the downward guiding portion 39 are disposed below the first exhaust passage 31. The exhaust that flows into the second exhaust passage 33 from the connection passage 32 is guided rearward by the rearward guiding portion 38 and then guided downward by the downward guiding portion 39. The exhaust that reaches the downstream end of the second exhaust passage 33 is exhausted toward an internal space of the exhaust guide 19 (see FIG. 1) from the second exhaust passage 33. The exhaust generated in the combustion chambers 17 is thus discharged from the cylinder head 18 to the exhaust pipe 27 and thereafter returned from the exhaust pipe 27 to the cylinder body 16.

Exhaust generated in accompaniment with combustion of a fuel containing hydrogen atoms contains moisture. Thus, when the exhaust is cooled, water (condensed water) may form inside the first exhaust passage 31. The outboard motor 3 includes a communication passage 40 as a condensed water passage. The communication passage 40 is narrower than the first exhaust passage 31, the connection passage 32, and the second exhaust passage 33. That is, a maximum flow passage area (i.e., a cross-sectional area) of the communication passage 40 is smaller than a minimum flow passage area of the first exhaust passage 31, the connection passage 32, and the second exhaust passage 33. A lower end portion of the first exhaust passage 31 is connected to the second exhaust passage 33 by the communication passage 40. The communication passage 40 extends from the lower end portion of the first exhaust passage 31 to the second exhaust passage 33. Water formed in the first exhaust passage 31 is thus discharged from the lower end portion of the first exhaust passage 31 into the communication passage 40 and is further discharged from the communication passage 40 into the second exhaust passage 33. Misfire of the engine 4 due to reverse flow of the water formed in the first exhaust passage 31 into the combustion chamber 17 is thus prevented.

Figure 3:
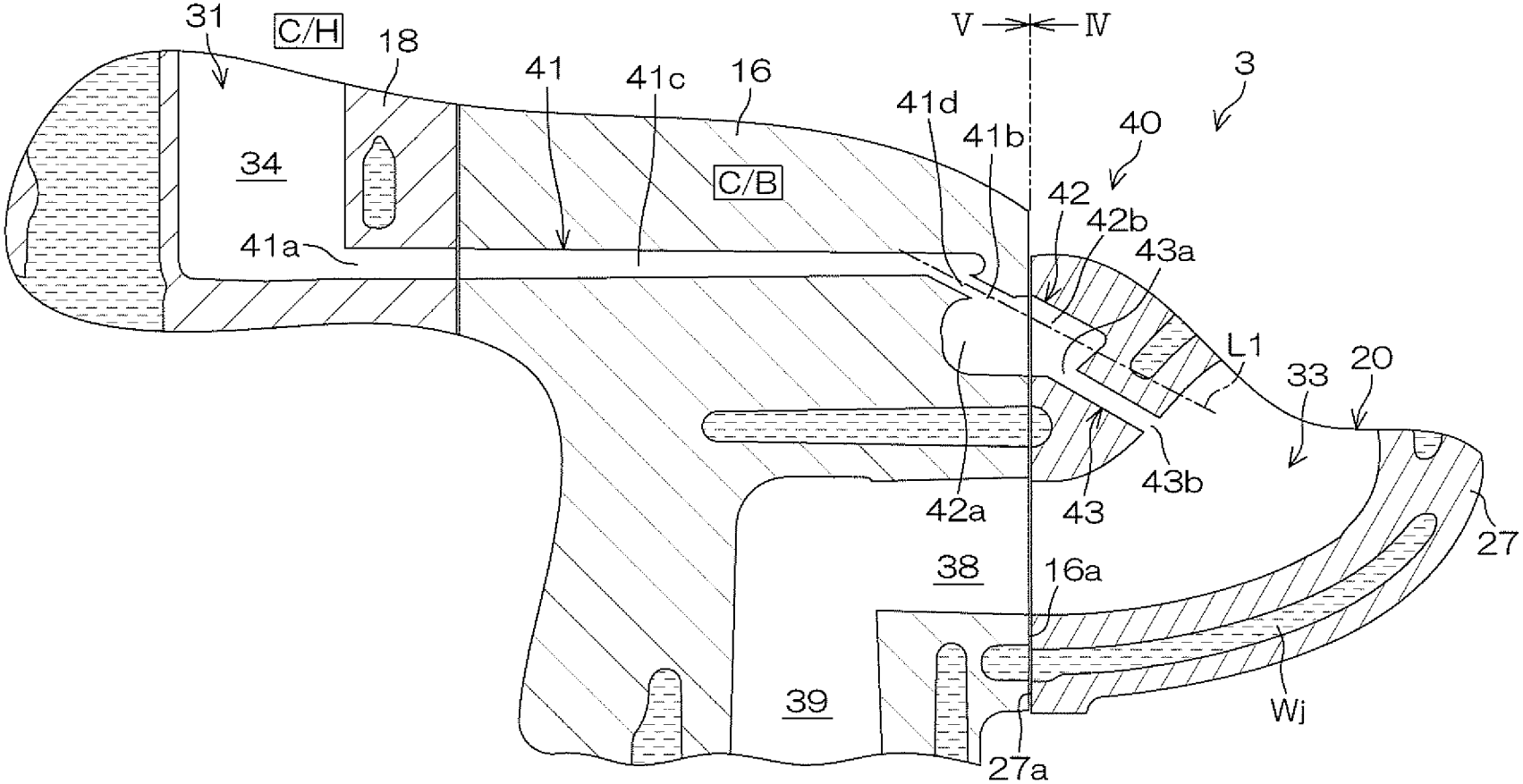
FIG. 3 is a sectional view of a communication passage and an arrangement related thereto.
Figure 4:
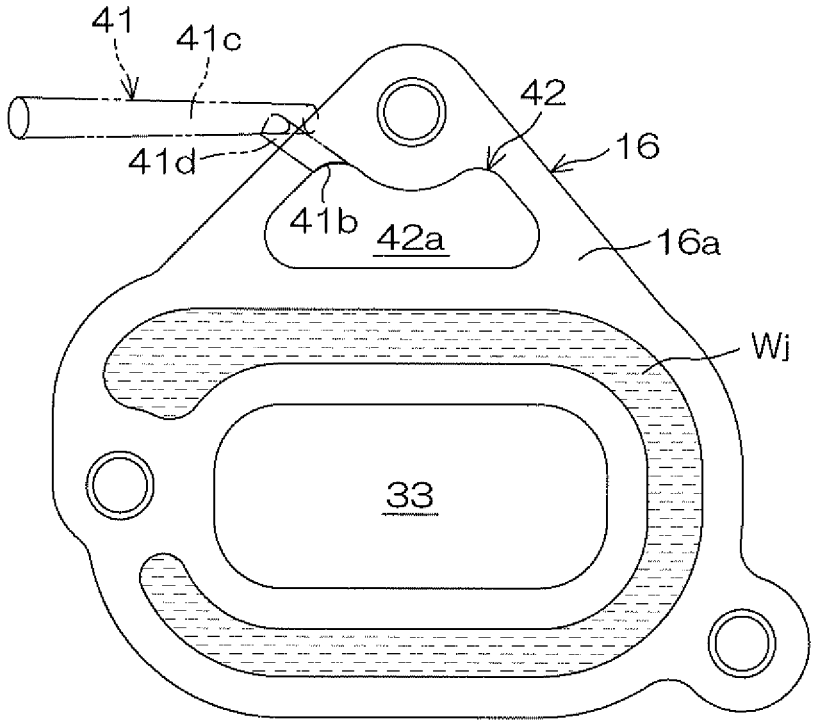
FIG. 4 is a view of an end surface of a cylinder body as viewed from a direction of an arrow IV shown in FIG. 3.
Figure 5:
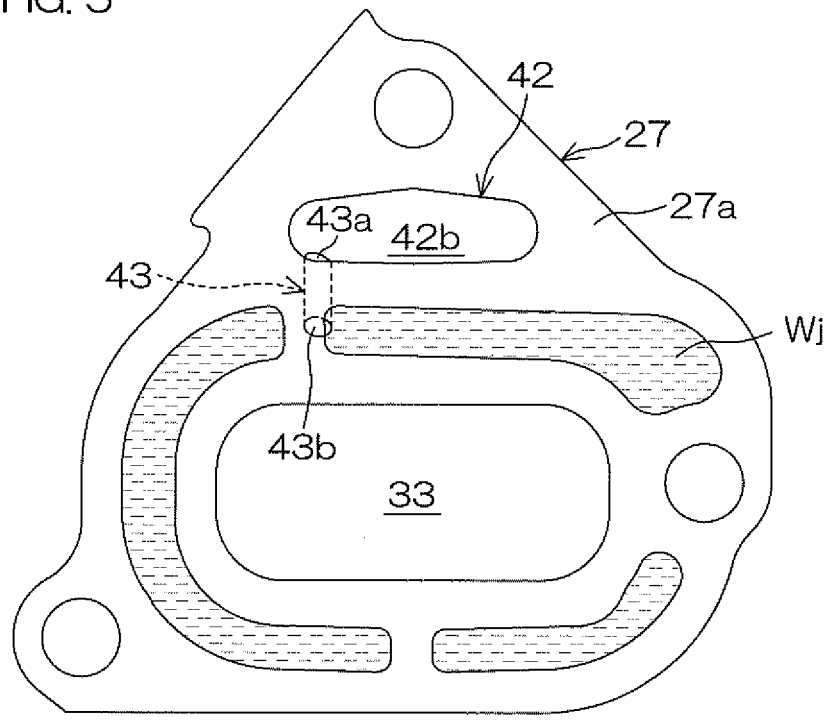
FIG. 5 is a view of an end surface of an exhaust pipe as viewed from a direction of an arrow V shown in FIG. 3.
Figure 6:
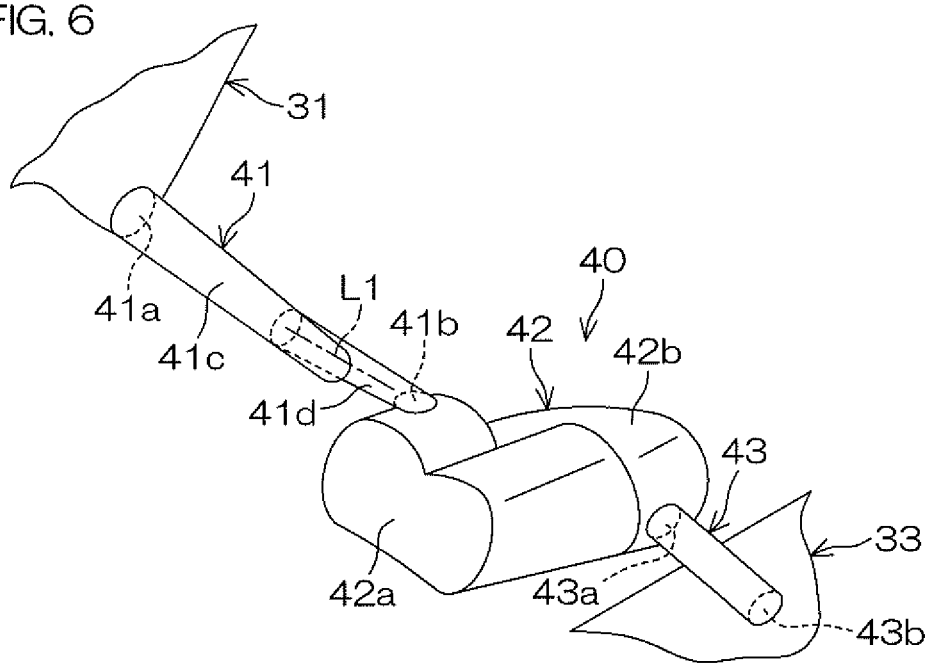
FIG. 6 is a perspective view of a spatial portion of the communication passage.

FIG. 3 is a sectional view of the communication passage 40 and an arrangement related thereto. FIG. 4 is a view of an end surface 16*a* of the cylinder body 16 as viewed from a direction of an arrow IV shown in FIG. 3. FIG. 5 is a view of an end surface 27*a* of the exhaust pipe 27 as viewed from a direction of an arrow V shown in FIG. 3. FIG. 6 is a perspective view of a spatial portion of the communication passage 40.

As shown in FIG. 3, the communication passage 40 includes a first passage portion 41 connected to the first exhaust passage 31, an expanded portion 42 connected to the first passage portion 41, and a second passage portion 43 connecting the expanded portion 42 and the second exhaust passage 33 portion. The second passage portion 43 connects the expanded portion 42 and the second exhaust passage 33 while passing in between the water jacket Wj. The expanded portion 42 is the most expanded portion among portions defining the communication passage 40. Thus, within the communication passage 40, the expanded portion 42 is largest in flow passage area (i.e., a cross-sectional area perpendicular or substantially perpendicular to a direction of flow of water). As shown in FIG. 6, the first passage portion 41 and the second passage portion 43 are linear spaces that are elongated in the water flow-through direction, and the expanded portion 42 is a block-shaped space that is broader (e.g., wider and higher) than either of the first passage portion 41 and the second passage portion 43.

As shown in FIG. 3, the communication portion 40 further includes a first upstream end 41*a* that opens at the first exhaust passage 31, a first downstream end 41*b* and a second upstream end 43*a* that open at the expanded portion 42, and a second downstream end 43*b* that opens at the second exhaust passage 33. The first passage portion 41 connects the first upstream end 41*a* and the first downstream end 41*b*, and the second passage portion 43 connects the second upstream end 43*a* and the second downstream end 43*b*. The first upstream end 41*a* is disposed above the second downstream end 43*b*. The first upstream end 41*a* defines an upper end of the communication passage 40, and the second downstream end 43*b* defines a lower end of the communication passage 40. The first upstream end 41*a* opens at the lower end portion of the first exhaust passage 31. The first upstream end 41*a* preferably opens at a lowermost end of the first exhaust passage 31.

As shown in FIG. 3, the expanded portion 42 is disposed at a height in between the first upstream end 41*a* and the second downstream end 43*b*. The first downstream end 41*b* and the second upstream end 43*a* that open at the expanded portion 42 are thus disposed at heights in between the first upstream end 41*a* and the second downstream end 43*b*. The first downstream end 41*b* is disposed above the second upstream end 43*a*. The first downstream end 41*b* may be disposed at the same height as the second upstream end 43*a* or may be disposed below the second upstream end 43*a*. The second upstream end 43*a* opens at the expanded portion 42. The second upstream end 43*a* preferably opens at a lowermost end of the expanded portion 42.

As shown in FIG. 3, a flow passage length of the first passage portion 41 is preferably longer than a flow passage length of the second passage portion 43. The first passage portion 41 is preferably bent and the second passage portion 43 preferably extends rectilinearly. The first passage portion 41 includes a rectilinear upstream portion 41*c* extending frontward (to the right in FIG. 3) from the first exhaust passage 31 and a rectilinear downstream portion 41*d* extending obliquely downward from the upstream portion 41*c* to the expanded portion 42. The upstream portion 41*c* may extend horizontally or may extend obliquely downward. The second passage portion 43 is preferably offset with respect to the downstream portion 41*d* and is disposed on an axis that preferably differs from an extension line L1 of the downstream portion 41*d*. The second upstream end 43*a* is thus disposed at a position that is not on the extension line L1 of the first passage portion 41. The first downstream end 41*b* and the second upstream end 43*a* thus do not face each other.

As shown in FIG. 3, the upstream portion 41*c* may have a tapered shape with which a diameter decreases from about 6 mmϕ, for example, to about 4 mmϕ, for example, as the upstream portion 41*c* approaches the expanded portion 42. The downstream portion 41*d* and the second passage portion 43 may have cylindrical shapes of fixed diameter (for example, about 4 mmϕ). A maximum flow passage area of the first passage portion 41 is thus greater than a maximum flow passage area of the second passage portion 43, and a minimum flow passage area of the first passage portion 41 is equal to the maximum flow passage area of the second passage portion 43. The upstream portion 41*c* is preferably formed by casting and the downstream portion 41*d* is preferably formed by cutting, for example. The expanded portion 42 is preferably formed by casting and the second passage portion 43 is preferably formed by cutting, for example. The upstream portion 41*c* may be formed by a processing method other than casting. The same applies to the downstream portion 41*d*, the expanded portion 42, and the second passage portion 43.

As shown in FIG. 3, the end surface 27*a* (attachment surface) of the exhaust pipe 27 is overlapped with the end surface 16*a* (attachment surface) of the cylinder body 16. The end surface 27*a* of the exhaust pipe 27 may be overlapped directly with the end surface 16*a* of the cylinder body 16 or may be overlapped with the end surface 16*a* of the cylinder body 16 via a gasket or other seal. As shown in FIG. 4, the second exhaust passage 33 opens at the end surface 16*a* of the cylinder body 16. The water jacket Wj surrounds an opening portion of the second exhaust passage 33 within the end surface 16*a* of the cylinder body 16. Likewise, as shown in FIG. 5, the second exhaust passage 33 opens at the end surface 27*a* of the exhaust pipe 27 and the water jacket Wj surrounds an opening portion of the second exhaust passage 33 within the end surface 27*a* of the exhaust pipe 27.

As shown in FIG. 3, the expanded portion 42 is defined by a plurality of members including the cylinder body 16 and the exhaust pipe 27. That is, the expanded portion 42 includes a pair of recessed portions (a first recessed portion 42*a* and a second recessed portion 42*b*) provided in the cylinder body 16 and the exhaust pipe 27. The first recessed portion 42*a* is provided in the cylinder body 16 and the second recessed portion 42*b* is provided in the exhaust pipe 27. The first downstream end 41*b* opens at an inner surface of the first recessed portion 42*a* and the second upstream end 43*a* opens at an inner surface of the second recessed portion 42*b*. The first recessed portion 42*a* is recessed from the end surface 16*a* of the cylinder body 16, and the second recessed portion 42*b* is recessed from the end surface 27*a* of the exhaust pipe 27. As shown in FIG. 4, an opening portion of the first recessed portion 42*a* is disposed at a periphery of the water jacket Wj, and as shown in FIG. 5, an opening portion of the second recessed portion 42*b* is disposed at a periphery of the water jacket Wj. As shown in FIG. 3, the first recessed portion 42*a* and the second recessed portion 42*b* are overlapped in a mutually facing state, and interiors of the first recessed portion 42*a* and the second recessed portion 42*b* are in mutual communication.

When in a state where the vessel is being driven forward, a shift position of the outboard motor 3 is switched to a reverse drive position, a force that rotates the propeller 8 in a reverse drive direction is transmitted from the propeller shaft 7 to the propeller 8. However, immediately after the shift position is switched to the reverse drive position, the vessel is driven forward by inertia and thus a force (hydraulic pressure) that rotates the propeller 8 in a forward drive direction is applied to the propeller 8. The force is thus transmitted to the crankshaft 12 via the propeller shaft 7, etc., and the crankshaft 12 may thus rotate in reverse. When the crankshaft 12 rotates in reverse, water that has entered inside the main exhaust passage 20 from the exhaust outlet 22 flows in reverse toward the combustion chambers 17.

As described above, with the present preferred embodiment, the communication passage 40 is preferably connected to the main exhaust passage 20. The water that flows in reverse in the main exhaust passage 20 may thus enter into the communication passage 40. However, the expanded portion 42 having a large volume is disposed between the first passage portion 41 and the second passage portion 43 and thus water that has entered the second passage portion 43 is jetted from the second upstream end 43*a* into the expanded portion 42 and decreases in flow velocity. The water that has entered the second passage portion 43 can thus be prevented from flowing into the main exhaust passage 20 through the expanded portion 42 and the first passage portion 41. Water flowing in reverse in the main exhaust passage 20 can thus be prevented from entering into the combustion chambers 17 through the communication passage 40 without passing through a portion of the main exhaust passage 20 (the upstream portion 35, midstream portion 36, and downstream portion 37). Misfire of the engine 4 can thereby be prevented.

Further with the present preferred embodiment, the second upstream end 43*a* is disposed at a position that is not on the extension line L1 of the first passage portion 41. Water flowing in reverse in the communication passage 40 passes through the second passage portion 43 and is jetted into the expanded portion 42 from the second upstream end 43*a*. The second passage portion 43 is offset with respect to the first passage portion 41 and thus the first downstream end 41*b* and the second upstream end 43*a* do not face each other in a water jetting direction from the second upstream end 43*a*. The water jetted from the second upstream end 43*a* can thus be prevented from entering directly into the first downstream end 41*b*. Water flowing in reverse in the second passage portion 43 can thus be prevented from entering into the first passage portion 41. Water flowing in reverse inside the second exhaust passage 33 can thus be prevented from entering into the combustion chamber 17 through the communication passage 40.

Although a preferred embodiment of the present invention has been described above, the present invention is not restricted to the contents of the above-described preferred embodiment and various modifications are possible within the scope of the claims.

Figure 7:
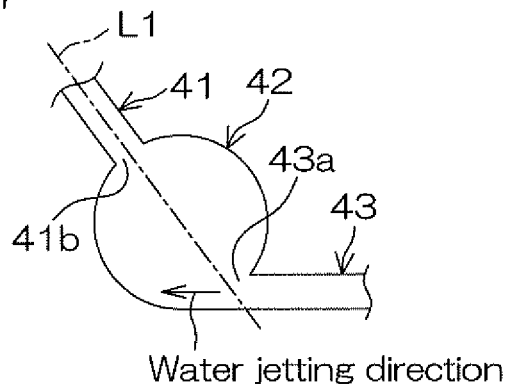
FIG. 7 is a schematic view of a communication passage according to another preferred embodiment of the present invention.

For example, with the preferred embodiment described above, a case where the second upstream end 43*a* is disposed at a position that is not on the extension line L1 of the first passage portion 41 was described. However, the second upstream end 43*a* may be disposed on the extension line L1 of the first passage portion 41. In this case, the second passage portion 43 may extend in a direction parallel to the first passage portion 41 or may be inclined with respect to the first passage portion 41 as shown in FIG. 7. In the case of the arrangement shown in FIG. 7, the first downstream end 41*b* and the second upstream end 43*a* face each other in a direction along the extension line L1 of the first passage portion 41 but do not face each other in the water jetting direction from the second upstream end 43*a* and thus water jetted from the second upstream end 43*a* can be prevented from entering directly into the first downstream end 41*b*.

Figure 8:
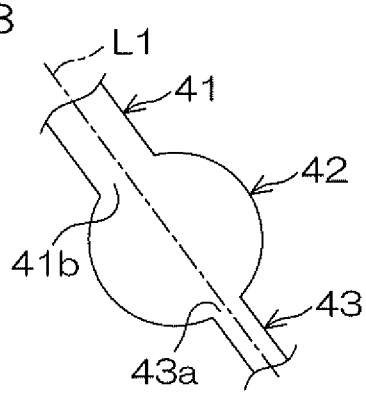
FIG. 8 is a schematic view of a communication passage according to yet another preferred embodiment of the present invention.

Also, with the preferred embodiment described above, a case where the maximum flow passage area of the first passage portion 41 is greater than the maximum flow passage area of the second passage portion 43 and the minimum flow passage area of the first passage portion 41 is equal to the maximum flow passage area of the second passage portion 43 was described. However, as shown in FIG. 8, the minimum flow passage area of the first passage portion 41 may be greater than the maximum flow passage area of the second passage portion 43. That is, it is preferable for at least the minimum flow passage area of the first passage portion 41 to be greater than the minimum flow passage area of the second passage portion 43.

Also, with the preferred embodiment described above, a case where the expanded portion 42 is defined by the cylinder body 16 and exhaust pipe 27 was described. However, the expanded portion 42 may instead be defined by the cylinder body 16 and the cylinder head 18.

Also, with the preferred embodiment described above, a case where the second passage portion 43 is provided in the exhaust pipe 27 was described. However, the second passage portion 43 may instead be provided in the cylinder head 18.

Also, with the preferred embodiment described above, a case where the flow passage length of the first passage portion 41 is longer than the flow passage length of the second passage portion 43 was described. However, the flow passage length of the first passage portion 41 may be equal to the flow passage length of the second passage portion 43 or may be shorter than the flow passage length of the second passage portion 43.

Also, with the preferred embodiment described above, a case where the first passage portion 41 is bent and the second passage portion 43 extends rectilinearly was described. However, both the first passage portion 41 and the second passage portion 43 may be bent or both the first passage portion 41 and the second passage portion 43 may extend rectilinearly. Obviously, the first passage portion 41 may extend rectilinearly and the second passage portion 43 may be bent.

The present application corresponds to Japanese Patent Application No. 2012-025113 filed on Feb. 8, 2012 in the Japan Patent Office, the entire disclosure of which is incorporated herein by reference.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A vessel propulsion apparatus comprising:

an engine including a crankshaft rotatable around a crank axis extending in a vertical direction;

a first exhaust passage including an upward guiding portion that guides exhaust generated by the engine upward;

a second exhaust passage that is disposed at a downstream side relative to the first exhaust passage and guides the exhaust generated by the engine;

an exhaust outlet that discharges the exhaust guided by the second exhaust passage underwater; and a communication passage that communicates the first exhaust passage and the second exhaust passage with each other and includes a first upstream end opening at the first exhaust passage, a second downstream end disposed below the first upstream end and opening at the second exhaust passage, and an expanded portion disposed at a height in between the first upstream end and the second downstream end and being more expanded than the first upstream end and the second downstream end.

2. The vessel propulsion apparatus according to claim 1, wherein a flow passage area of the expanded portion is greater than an opening area of either of the first upstream end and the second downstream end.

3. The vessel propulsion apparatus according to claim 1, wherein the communication passage further includes a first downstream end and a second upstream end each opening at the expanded portion, a first passage portion connecting the first upstream end and the first downstream end and being narrower than the expanded portion, and a second passage portion connecting the second upstream end and the second downstream end and being narrower than the expanded portion; and the second upstream end is disposed at a position that is not on an extension line extending along the first passage portion.

4. The vessel propulsion apparatus according to claim 1, wherein the communication passage further includes a first downstream end and a second upstream end each opening at the expanded portion, a first passage portion connecting the first upstream end and the first downstream end and being narrower than the expanded portion, and a second passage portion connecting the second upstream end and the second downstream end and being narrower than the expanded portion; and the second upstream end is disposed on an extension line of the first passage portion and the second passage portion is inclined with respect to the first passage portion.

5. The vessel propulsion apparatus according to claim 1, wherein the communication passage further includes a first passage portion connecting the first upstream end and the expanded portion and being narrower than the expanded portion, and a second passage portion connecting the expanded portion and the second downstream end and being narrower than the expanded portion; and a flow passage area of the first passage portion is greater than a flow passage area of the second passage portion.

6. The vessel propulsion apparatus according to claim 1, wherein the communication passage further includes a first downstream end and a second upstream end each opening at the expanded portion, a first passage portion connecting the first upstream end and the first downstream end and being narrower than the expanded portion, and a second passage portion connecting the second upstream end and the second downstream end and being narrower than the expanded portion; and the second upstream end opens at a lowermost end of the expanded portion.

7. The vessel propulsion apparatus according to claim 1, wherein the first upstream end opens at a lowermost end of the first exhaust passage.

8. The vessel propulsion apparatus according to claim 1, further comprising a connection passage connecting the first exhaust passage and the second exhaust passage and including a catalyst disposed therein.

9. The vessel propulsion apparatus according to claim 1, further comprising a water jacket that cools at least a portion of the first exhaust passage.

10. The vessel propulsion apparatus according to claim 9, further comprising a cooling device that supplies water outside the vessel propulsion apparatus to the water jacket.

11. The vessel propulsion apparatus according to claim 1, wherein the expanded portion is defined by a plurality of members of the engine.

12. The vessel propulsion apparatus according to claim 11, wherein the expanded portion includes a pair of recessed portions that are provided in the plurality of members and overlapped in a mutually facing state.

* * * * *